US009193184B2

(12) United States Patent
Ando

(10) Patent No.: US 9,193,184 B2
(45) Date of Patent: Nov. 24, 2015

(54) INKJET RECORDING APPARATUS

(71) Applicant: KYOCERA Document Solutions Inc., Osaka (JP)

(72) Inventor: Yoshihiro Ando, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 22 days.

(21) Appl. No.: 14/470,412

(22) Filed: Aug. 27, 2014

(65) Prior Publication Data

US 2015/0062273 A1 Mar. 5, 2015

(30) Foreign Application Priority Data

Aug. 30, 2013 (JP) ..... 2013-179429

(51) Int. Cl.
*B41J 2/01* (2006.01)
*B41J 11/00* (2006.01)
*B41J 13/10* (2006.01)

(52) U.S. Cl.
CPC ..... *B41J 11/0045* (2013.01); *B41J 11/007* (2013.01); *B41J 13/106* (2013.01)

(58) Field of Classification Search
CPC ..... B41J 11/0045; B41J 11/007; B41J 11/06; B41J 11/0085; B41J 13/103; B41J 11/0065
See application file for complete search history.

(56) References Cited

U.S. PATENT DOCUMENTS

| | | | | |
|---|---|---|---|---|
| 7,021,757 | B2 * | 4/2006 | Kida | 347/104 |
| 2009/0108519 | A1 * | 4/2009 | Baba | 271/264 |
| 2009/0121422 | A1 | 5/2009 | Imoto | 271/272 |
| 2011/0102530 | A1 * | 5/2011 | Yamamoto | 347/104 |
| 2012/0081487 | A1 * | 4/2012 | Tanaka et al. | 347/104 |
| 2012/0292848 | A1 | 11/2012 | Imoto | 271/188 |

FOREIGN PATENT DOCUMENTS

| | | | |
|---|---|---|---|
| JP | 7-251997 | A | 10/1995 |
| JP | 2002-60111 | A | 2/2002 |
| JP | 2008-1522 | A | 1/2008 |

* cited by examiner

*Primary Examiner* — Justin Seo
*Assistant Examiner* — Jeremy Delozier
(74) *Attorney, Agent, or Firm* — Stein IP, LLC

(57) ABSTRACT

An inkjet recording apparatus includes a first belt transporting unit for transporting a recording medium by absorbing and supporting, a recording unit disposed to face the first belt transporting unit to eject ink to the recording medium, a second belt transporting unit disposed adjacent to the first belt transporting unit on a downstream side in a transport direction to transport the recording medium by absorbing and supporting, and a transport guiding unit disposed to face a transporting surface of the second transporting unit. A surface of the transport guiding unit facing the second transporting unit is provided with a plurality of ribs extending in the transport direction. Protruding heights of the ribs with respect to the transporting surface of the second transporting unit are gradually decreased from an outermost rib to an innermost rib in a width direction of the recording medium.

9 Claims, 9 Drawing Sheets

INKJET RECORDING APPARATUS

This application is based upon and claims the benefit of priority from the corresponding Japanese Patent Application No. 2013-179429 filed Aug. 30, 2013, the entire contents of which are incorporated herein by reference.

BACKGROUND OF THE INVENTION

The present disclosure relates to an inkjet recording apparatus for recording by ejecting ink to a recording medium such as a paper sheet.

Recording apparatuses such as a facsimile, a copier, a printer, and the like are configured to record an image on a recording medium such as a paper sheet, an OHP sheet, or the like, and can be classified into an inkjet type, a wire dot type, a thermal type, and the like in accordance with methods of recording. In addition, inkjet recording methods can be classified into a serial type in which recording is performed by a recording head scanning the recording medium and a line head type in which recording is performed by a recording head fixed to the recording apparatus main body.

For instance, the line head type inkjet recording apparatus is equipped with a line head type inkjet head (recording head) for each color, in which ejection nozzles are aligned at a predetermined interval in the entire width of a printing area perpendicular to a transport direction of the recording medium. Further, ejection nozzles corresponding to printing positions eject ink in synchronization with transportation of the recording medium so as to print on the entire recording medium.

In this inkjet recording apparatus, the recording medium after printing by the recording head causes upward or downward warp as the ink is dried, and hence the transportation of the recording medium is apt to be unstable. In order to suppress the warp of the recording medium, it is preferred to decrease an interval between transport paths for the recording medium after printing as much as possible. On the other hand, when the interval between transport paths is decreased, there occurs a problem that wet ink adheres to a transport guide or that the adhered ink is retransferred to the recording medium so as to cause offset.

Therefore, there is known a recording apparatus in which a recording surface side of the transport path is opened from recording means to discharging means, and among discharge rollers and discharge spur rollers constituting the discharging means, an outer diameter of the discharge spur roller on the recording surface side is made larger than an outer diameter of the discharge roller on a back side.

In addition, there is known an inkjet recording apparatus in which a paper sheet pressing member opposed to the recording surface of the paper sheet is disposed, and the paper sheet pressing member presses width direction end portions of the paper sheet transported along a rib of a print receiving member so that warp of the paper sheet is suppressed. Further, there is known an inkjet printer equipped with a plurality of guiding curved members for guiding the recording medium after printing to a discharge tray in such a manner that positions of the width direction end portions of the recording medium are higher than a position of a width direction center portion.

However, in the method of setting the outer diameter of the discharge spur roller on the recording surface side to be larger than the outer diameter of the discharge roller on the back side, because the recording surface side of the transport path is opened, a leading end of the recording medium cannot enter a nip between the discharge roller and the discharge spur roller when a warp exceeding a supposed range occurs in the recording medium. As a result, there occurs a problem, such as a jam or skew of the recording medium, or a conspicuous image defect is generated.

In addition, in the method of suppressing warp of the paper sheet by pressing width direction end portions of the paper sheet transported along a rib of the print receiving member by the paper sheet pressing member, the paper sheet is transported in a state where the paper sheet is sandwiched between the paper sheet pressing member opposed to the recording surface of the paper sheet and the rib opposed to the surface opposite to the recording surface. Therefore, an image recorded on the recording surface of the paper sheet may be rubbed and damaged by the paper sheet pressing member.

In addition, in the method of using the plurality of guiding curved members for guiding the recording medium after printing to the discharge tray in such a manner that positions of the width direction end portions of the recording medium are higher than a position of the width direction center portion, the recording medium is transported in a state where the guiding curved members support the lower surface of the recording medium so that positions of the width direction end portions are higher than a position of the width direction center portion. Therefore, the recording medium can be stably supported when the width direction center of the recording medium warps downward, but the recording medium may not be stably supported when the width direction center of the recording medium warps upward. Further, in this structure, the recording medium is transported in a state where one width direction end of the recording medium contacts with a reference wall. Therefore, upward or downward warp of a small size recording medium cannot be suppressed symmetrically in the width direction.

SUMMARY OF THE INVENTION

An inkjet recording apparatus according to an aspect of the present disclosure includes a first belt transporting unit, a recording unit, a second belt transporting unit, and a transport guiding unit. The first belt transporting unit includes a first transporting belt configured to transport a recording medium by absorbing and supporting the same. The recording unit is disposed to be opposed to the first belt transporting unit and ejects ink to the recording medium transported by the first transporting belt. The second belt transporting unit is disposed adjacent to the first belt transporting unit on a downstream side thereof in a transport direction of the recording medium and includes a second transporting belt configured to transport the recording medium by absorbing and supporting the same. The transport guiding unit is disposed to be opposed to a transporting surface of the second transporting belt. A plurality of ribs extending in the transport direction of the recording medium are formed on a surface of the transport guiding unit facing the second transporting belt, and protruding heights of the ribs toward the transporting surface of the second transporting belt are set to be decreased gradually from an outermost rib to an innermost rib in the width direction of the recording medium.

Other objects of the present disclosure and specific advantages obtained from the present disclosure will become more apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
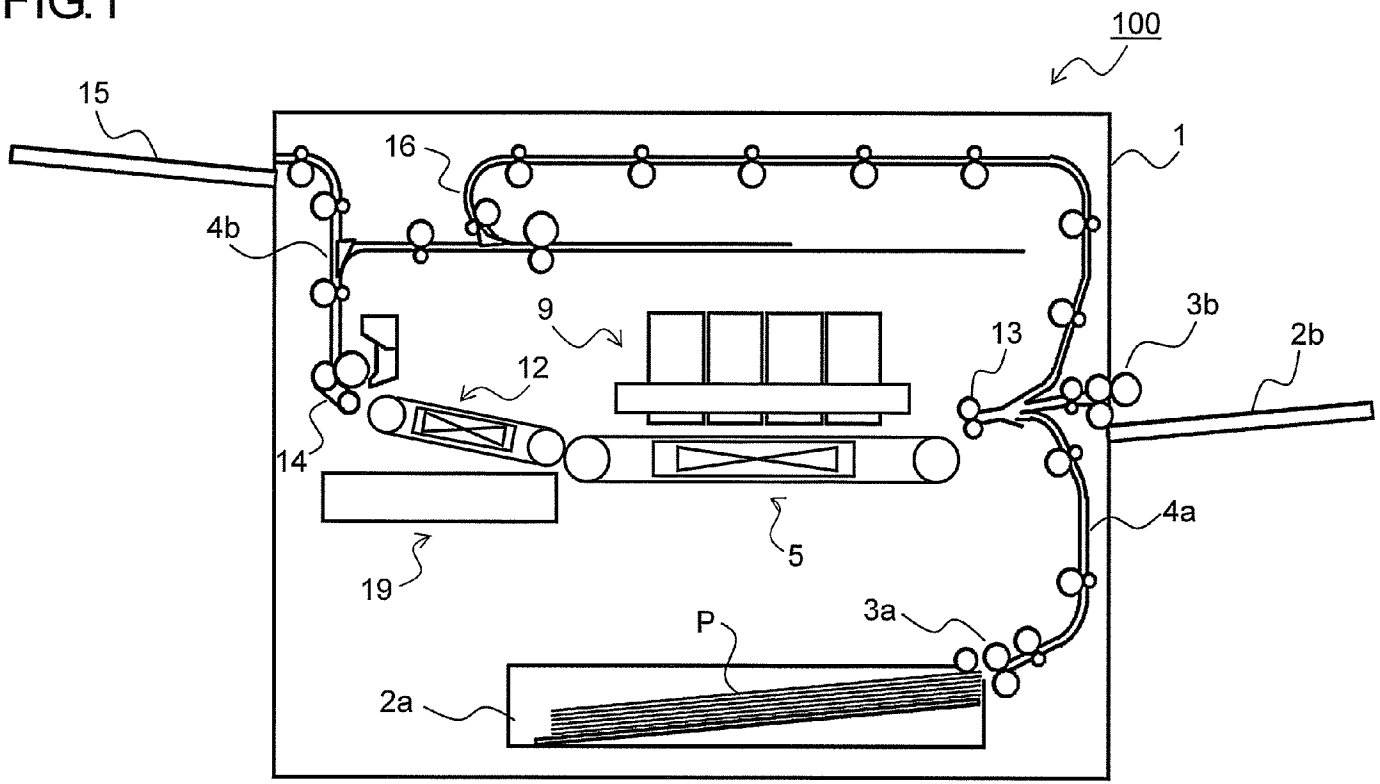
FIG. 1 is a side cross-sectional view illustrating a structure of a printer as an example of an inkjet recording apparatus according to a first embodiment of the present disclosure.
Figure 2:
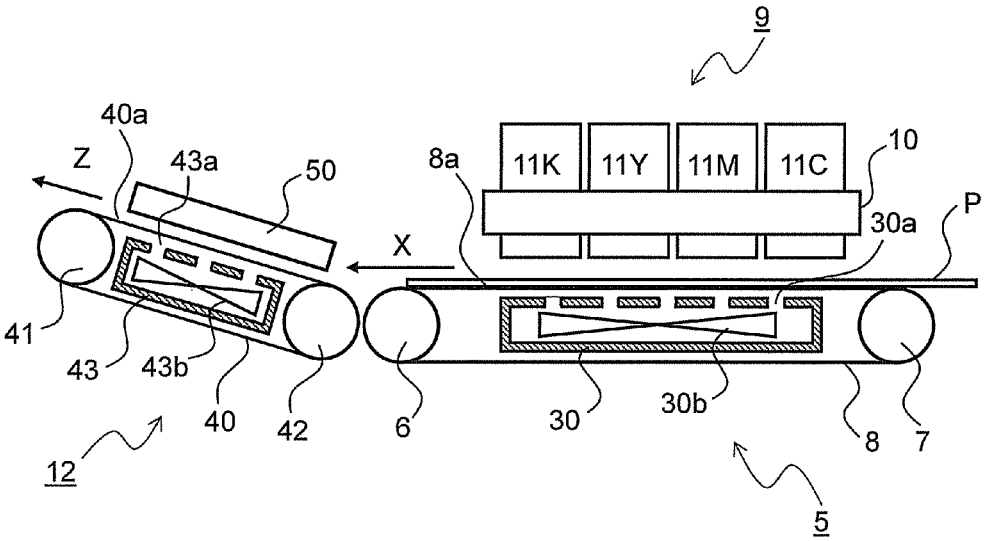
FIG. 2 is a partial enlarged view of a first belt transporting unit, a recording unit, a second belt transporting unit, and vicinity thereof in the printer of FIG. 1.

Now, an inkjet recording apparatus according to the present disclosure is described with reference to the drawings. FIG. 1 is a side cross-sectional view illustrating a structure of an inkjet printer 100 as an example of the inkjet recording apparatus according to a first embodiment of the present disclosure. FIG. 2 is a partial enlarged view of a first belt transporting unit 5, a recording unit 9, a second belt transporting unit 12, and vicinity thereof in FIG. 1.

As illustrated in FIG. 1, the printer 100 is provided with a sheet feed cassette 2*a* as a paper sheet storing unit disposed in a lower part inside a printer main body 1. A predetermined number of paper sheets P (for example, approximately 500 sheets) such as cut paper sheets as an example of recording media are stacked and stored in the sheet feed cassette 2*a*. On a paper sheet transport direction downstream side of the sheet feed cassette 2*a*, namely on an upper right side of the sheet feed cassette 2*a* in FIG. 1, there is disposed a sheet feeding device 3*a*. This sheet feeding device 3*a* separates and feeds the paper sheets P one by one to the upper right from the sheet feed cassette 2*a* in FIG. 1. The sheet feed cassette 2*a* can be drawn out of the printer main body 1 horizontally from a front side so as to supply the paper sheets P.

On the right outside of the printer main body 1, there is disposed a manual sheet feed tray 2*b*. A paper sheet of a size different from the paper sheets P in the sheet feed cassette 2*a*, or a recording medium such as a thick paper sheet, an OHP sheet, an envelope, a post card, an invoice card, or the like that is difficult to pass through the bent transport path, or a recording medium to be fed manually one by one, or the like are placed on the manual sheet feed tray 2*b*. A sheet feeding device 3*b* is disposed on the downstream side of the paper sheet transport direction of the manual sheet feed tray 2*b*, namely on the left side of the manual sheet feed tray 2*b* in FIG. 1. This sheet feeding device 3*b* separates and feeds the paper sheets on the manual sheet feed tray 2*b* one by one toward the left direction in FIG. 1.

In addition, the printer 100 includes a first paper sheet transport path 4*a* inside. The first paper sheet transport path 4*a* is disposed on the upper right in the sheet feed direction from the sheet feed cassette 2*a* and is disposed on the left of the manual sheet feed tray 2*b*. The paper sheet P sent out from the sheet feed cassette 2*a* passes the first paper sheet transport path 4*a* and is transported upward along a side face of the printer main body 1, and the paper sheet sent from the manual sheet feed tray 2*b* is transported to the left substantially horizontally.

A registration roller pair 13 is disposed on the downstream end of the first paper sheet transport path 4*a* in the paper sheet transport direction. Further, the first belt transporting unit 5 and the recording unit 9 are disposed very close to the registration roller pair 13 on the downstream side. The paper sheet P sent out from the sheet feed cassette 2*a* (or the manual sheet feed tray 2*b*) passes the first paper sheet transport path 4*a* and reaches the registration roller pair 13. The registration roller pair 13 corrects skew of the paper sheet P and sends out the paper sheet P to the first belt transporting unit 5 in synchronization with timing of ink ejection operation executed by the recording unit 9. Note that the first paper sheet transport path 4*a* is provided with transport roller pairs for transporting the paper sheet P at appropriate positions.

The first belt transporting unit 5 includes an endless first transporting belt 8 stretched around a first drive roller 6 and a first driven roller 7. The first transporting belt 8 rotates in a counterclockwise direction by the first drive roller 6 in FIG. 2. The paper sheet P sent out by the registration roller pair 13 is held on a transporting surface 8*a* (upper surface in FIG. 2) of the first transporting belt 8 and is transported in the direction indicated by an arrow X in FIG. 2 (from right to left). Note that one or more tension rollers contacting with an inner surface of the first transporting belt 8 may be disposed as necessary in addition to the first drive roller 6 and the first driven roller 7.

A first paper sheet suction unit 30 is disposed at a position opposed to the backside of the transporting surface 8*a* of the first transporting belt 8 inside the first transporting belt 8. The first paper sheet suction unit 30 has many air suction holes 30*a* in the upper surface and includes a blower fan 30*b* inside, so as to suck air from the upper surface downward. In addition, the first transporting belt 8 is also provided with many air suction through holes (not shown). With the structure described above, the first belt transporting unit 5 transports the paper sheet P by absorbing and supporting the same on the transporting surface 8*a* of the first transporting belt 8.

The recording unit 9 includes line heads 11C, 11M, 11Y, and 11K for recording an image on the paper sheet P transported by being absorbed and supported on the transporting surface 8*a*. Corresponding to image data received from an external computer or the like, the line heads 11C to 11K eject ink sequentially toward the paper sheet P absorbed by the first transporting belt 8, so that a full color image is recorded on the paper sheet P, on which four colors, namely, yellow, magenta, cyan, and black colors are superimposed. Note that the printer 100 can also record a monochrome image.

In addition, in order to prevent an ink ejection defect due to drying or clogging of the recording head, the recording unit 9 performs purging in which ink having high viscosity in a nozzle is ejected from all ink ejection nozzles of the recording head when starting printing after a long interval, or from ink ejection nozzles having an ink ejection amount of a predetermined value or smaller between printing operations, so as to be ready for a next printing operation.

On the downstream side in the paper sheet transport direction (left side in FIG. 1) of the first belt transporting unit 5, there is disposed the second belt transporting unit 12. The paper sheet P on which an ink image is recorded by the recording unit 9 is sent to the second belt transporting unit 12, and the ink ejected onto the surface of the paper sheet P is dried while the paper sheet P passes the second belt transporting unit 12.

The second belt transporting unit 12 includes an endless second transporting belt 40 stretched around a second drive roller 41 and a second driven roller 42. The second transporting belt 40 is rotated by the second drive roller 41 in the counterclockwise direction in FIG. 2. The paper sheet P on which an image is recorded by the recording unit 9 is transported in the direction of the arrow X by the first belt transporting unit 5 and is received by the second transporting belt 40 so as to be transported in a direction of an arrow Z in FIG. 2. Note that one or more tension rollers contacting with an inner surface of the second transporting belt 40 may be disposed as necessary in addition to the second drive roller 41 and the second driven roller 42.

A second paper sheet suction unit 43 is disposed at a position opposed to the backside of a transporting surface 40*a* of the second transporting belt 40 inside the second transporting belt 40. The second paper sheet suction unit 43 has many air suction holes 43*a* in the upper surface and includes a blower fan 43*b* inside, so as to suck air from the upper surface downward. In addition, the second transporting belt 40 is also provided with many air suction through holes 40*b* (see FIG. 7). With the structure described above, the second belt transporting unit 12 transports the paper sheet P by absorbing and supporting the same on the transporting surface 40*a* of the second transporting belt 40.

In addition, a transport guiding unit 50 is disposed at a position opposed to the transporting surface 40*a* of the second transporting belt 40. The transport guiding unit 50 constitutes a paper sheet transport path together with the transporting surface 40*a* of the second transporting belt 40 so as to suppress warp or flutter of the paper sheet P absorbed and supported on the transporting surface 40*a* by the second paper sheet suction unit 43. A detailed structure of the transport guiding unit 50 is described later.

On the downstream side of the second belt transporting unit 12 in the paper sheet transport direction, namely in a vicinity of the left side of the printer main body 1, there is disposed a decurler unit 14. The paper sheet P whose ink is dried by the second belt transporting unit 12 is sent to the decurler unit 14, and curl of the paper sheet P is corrected by a plurality of rollers aligned in the paper sheet width direction.

On the downstream side in the paper sheet transport direction (upper side in FIG. 1) of the decurler unit 14, there is disposed a second paper sheet transport path 4*b*. The paper sheet P after passing the decurler unit 14 is discharged to a paper sheet discharge tray 15 disposed on the left outside of the printer 100 from the second paper sheet transport path 4*b* via a discharge roller pair when double-sided recording is not performed.

In addition, a maintenance unit 19 is disposed below the second belt transporting unit 12. The maintenance unit 19 moves to a position below the recording unit 9 when the above-mentioned purging is performed, so as to wipe ink ejected from ink ejection nozzles 18 (see FIG. 3) of a recording head 17 and to collect the wiped ink.

Above the recording unit 9 and the second belt transporting unit 12 in an upper part of the printer main body 1, there is disposed a reverse transport path 16 for performing the double-sided recording. When the double-sided recording is performed, the paper sheet P after a first side thereof has been printed and after passing the second belt transporting unit 12 and the decurler unit 14 passes the second paper sheet transport path 4*b* and is sent to the reverse transport path 16. The paper sheet P sent to the reverse transport path 16 is switched in its transport direction for recording a second side next, is sent to the right passing the upper part of the printer main body 1, and is sent again to the first belt transporting unit 5 in a state where the second side faces upward via the first paper sheet transport path 4*a* and the registration roller pair 13. Note that transport roller pairs for transporting the paper sheet P are disposed at appropriate positions in the second paper sheet transport path 4*b* and the reverse transport path 16 similarly to the first paper sheet transport path 4*a*.

Figure 3:
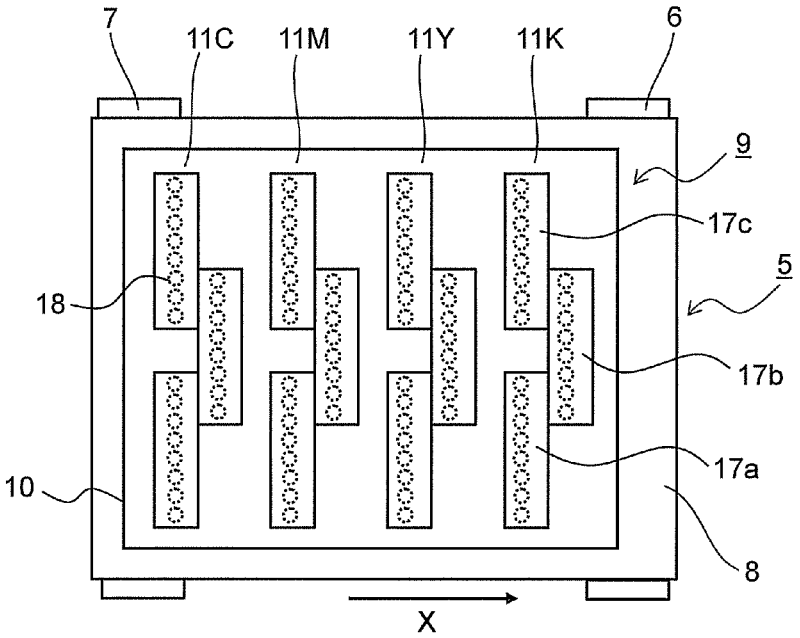
FIG. 3 is a plan view of the first belt transporting unit and the recording unit of the printer illustrated in FIG. 1 viewed from above.
Figure 4:
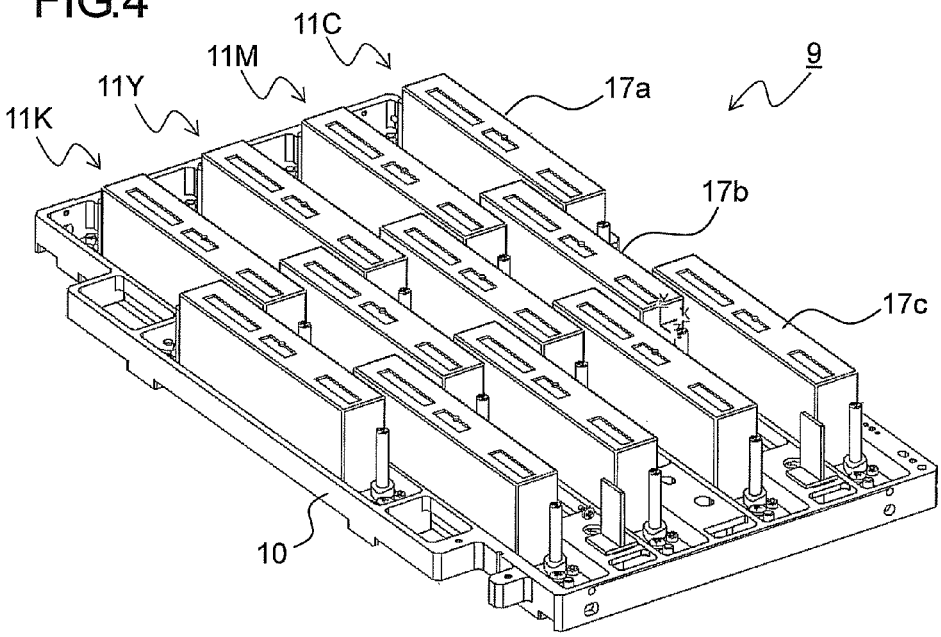
FIG. 4 is a perspective view of the recording unit of the printer viewed obliquely from above.
Figure 5:
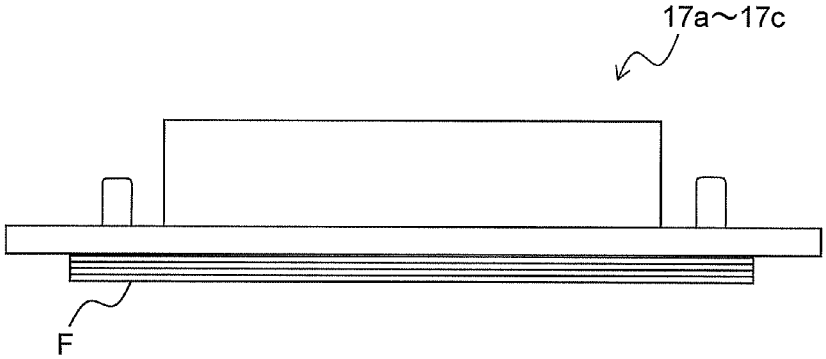
FIG. 5 is a side view of a recording head constituting a line head of the recording unit.
Figure 6:
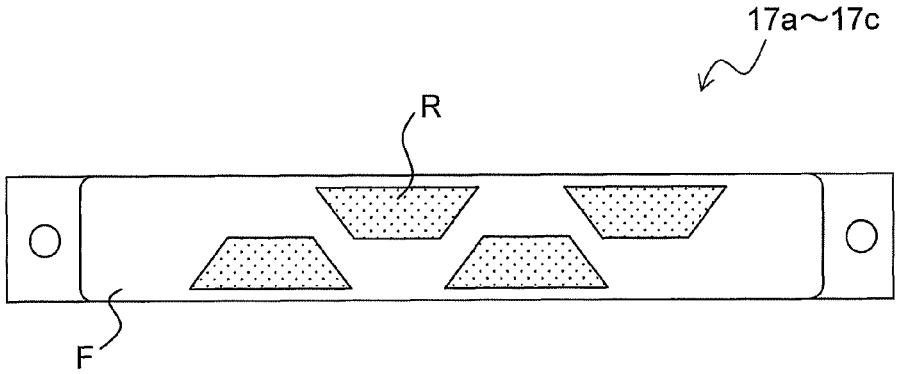
FIG. 6 is a plan view of the recording head viewed from an ink ejecting surface side.

FIG. 3 is a plan view of the first belt transporting unit 5 and the recording unit 9 of the printer 100 illustrated in FIG. 1 viewed from above. FIG. 4 is a perspective view of the recording unit 9 viewed obliquely from above. FIG. 5 is a side view of recording heads 17*a* to 17*c* constituting the line heads 11C to 11K of the recording unit 9. FIG. 6 is a plan view of the recording heads 17*a* to 17*c* viewed from an ink ejecting surface F side. Note that FIG. 3 illustrates a state of the recording unit 9 viewed from rear in FIG. 1, in which the line heads 11C to 11K are arranged in the opposite direction to FIG. 1 and FIG. 2. In addition, because the recording heads 17*a* to 17*c* have the same shape and structure, FIG. 5 and FIG. 6 illustrate the recording heads 17*a* to 17*c* as one figure.

The recording unit 9 includes a head housing 10 and the line heads 11C, 11M, 11Y, and 11K held by the head housing 10. These line heads 11C to 11K are supported at a height such that a predetermined interval (for example, 1 mm) is formed with respect to the transporting surface 8*a* of the first transporting belt 8. As illustrated in FIG. 3, a plurality of (three in this example) recording heads 17*a* to 17*c* are arranged in a zig-zag manner along a paper sheet width direction (up and down direction in FIG. 3) perpendicular to the paper sheet transport direction. The line heads 11C to 11K have a recording area whose width is equal to or wider than the width of the transported paper sheet P. Thus, the ink ejection nozzle 18 corresponding to a printing position can eject ink to the paper sheet P transported on the first transporting belt 8.

As illustrated in FIG. 6, the ink ejecting surface F of the recording heads 17*a* to 17*c* is provided with nozzle regions R in which many ink ejection nozzles 18 (see FIG. 5) are arranged. In addition, as illustrated in FIG. 3 and FIG. 4, the three recording heads 17*a* to 17*c* constituting the same line head 11C to 11K are disposed so that the ink ejection nozzles 18 disposed to the recording heads 17*a* to 17*c* are partially overlapped in the paper sheet transport direction.

The recording heads 17*a* to 17*c* constituting the line heads 11C to 11K are supplied with four colors (cyan, magenta, yellow, and black) of ink stored in ink tanks (not shown) corresponding to the line heads 11C to 11K.

The recording heads 17*a* to 17*c* eject ink from the ink ejection nozzle 18 to the paper sheet P transported by being absorbed and supported on the transporting surface 8*a* of the first transporting belt 8 in accordance with image data received from the external computer or the like. Thus, a full color image superimposed inks of four colors, cyan, magenta, yellow, and black, is formed on the paper sheet P on the first transporting belt 8.

In addition, in order to prevent an ink ejection defect due to drying or clogging of the recording heads 17*a* to 17*c*, the purging is performed in which ink having high viscosity in nozzles is ejected from the ink ejection nozzles 18 of all recording heads 17*a* to 17*c* when starting printing after a long interval, or from the ink ejection nozzles 18 of the recording heads 17*a* to 17*c* having ink ejection amount of a predetermined value or smaller between printing operations, so as to be ready for next printing operation.

Further, as a method of ejecting ink from the recording heads 17*a* to 17*c*, for example, there are various methods such as a piezoelectric method using a piezoelectric element (not shown) for ejecting ink, or a thermal inkjet method using a heating element for generating a bubble so as to apply a pressure on the ink to be ejected.

Figure 7:
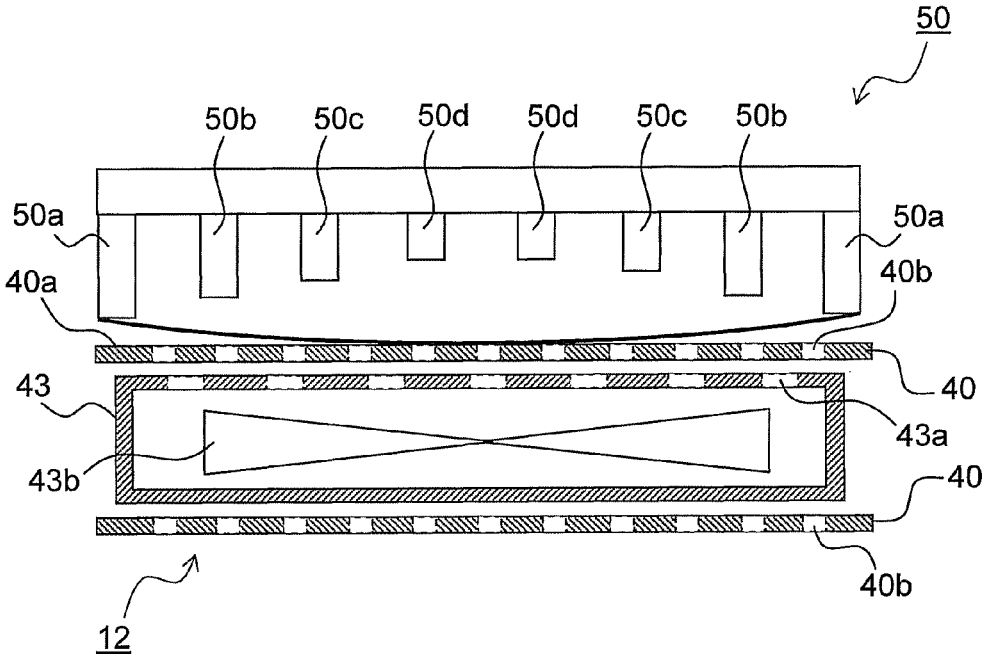
FIG. 7 is a side cross-sectional view of the second belt transporting unit and a transport guiding unit of the printer of the first embodiment, and is a diagram illustrating a manner in which a paper sheet P whose width direction center warps downward is transported.

FIG. 7 is a side cross-sectional view of the second belt transporting unit 12 and the transport guiding unit 50 of the printer 100 of the first embodiment, and illustrates cross sections of the second belt transporting unit 12 and the transport guiding unit 50 in a direction perpendicular to the paper sheet transport direction.

The transport guiding unit 50 includes ribs 50*a* to 50*d* disposed on a surface facing the transporting surface 40*a* of the second transporting belt 40 so as to protrude and extending in the paper sheet transport direction (perpendicular to the paper plane of FIG. 7). Four pairs of (total eight) ribs 50*a* to 50*d* are disposed in a symmetric manner in left and right with respect to the center in the paper sheet width direction (left and right direction in FIG. 7). In addition, protruding heights of the ribs 50*a* to 50*d* are set so as to gradually decrease from the outermost rib 50*a* in the paper sheet width direction to the innermost rib 50*d* in the paper sheet width direction. The curb connecting distal ends of the ribs 50*a* to 50*d* has an arch shape.

With this structure, as illustrated in FIG. 7, when the width direction center of the paper sheet P warps downward, width direction both ends of the paper sheet P are pressed downward by the outermost ribs 50*a*. Therefore, the paper sheet P having a downward warp can be securely sucked and supported for transportation by the transporting surface 40*a* of the second transporting belt 40.

Figure 8:
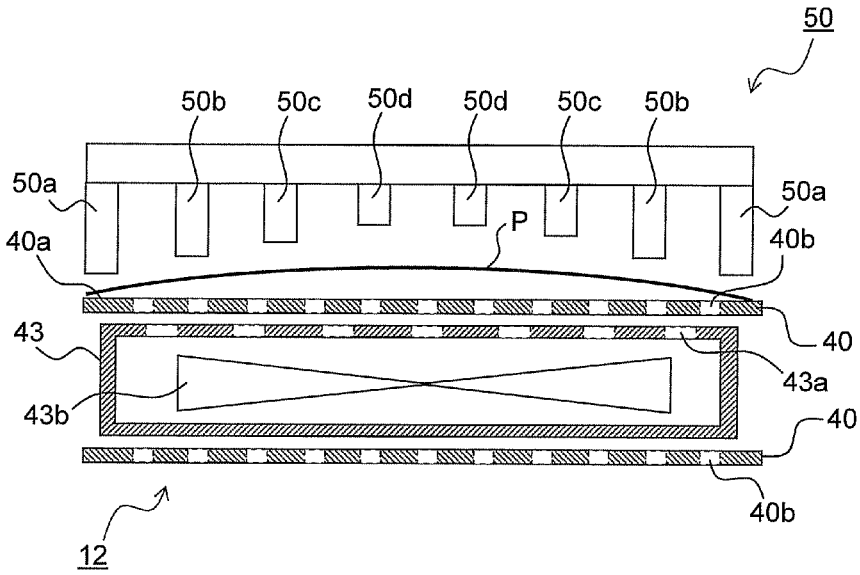
FIG. 8 is a side cross-sectional view of the second belt transporting unit and the transport guiding unit of the printer of the first embodiment, and is a diagram illustrating a manner in which the paper sheet whose width direction center warps upward is transported.

On the other hand, as illustrated in FIG. 8, when the width direction center of the paper sheet P warps upward, the width direction both ends of the paper sheet P is pressed downward by the outermost ribs 50*a*. As a result, flutter of the paper sheet P can be suppressed, and jam or skew of the paper sheet P can be effectively suppressed. In addition, because the curb connecting the distal ends of the ribs 50*a* to 50*d* has an arch shape, the ribs 50*a* contact only with the width direction both ends of the paper sheet P. Therefore, it is possible to avoid the problem that an image recorded on the upper surface of the paper sheet P having an upward warp is rubbed and damaged by the ribs 50*b* to 50*d*.

An arrangement interval and the protruding heights of the ribs 50*a* to 50*d* should be appropriately set in accordance with a type of the transported paper sheet P, a size in the width direction, and the like.

Figure 9:
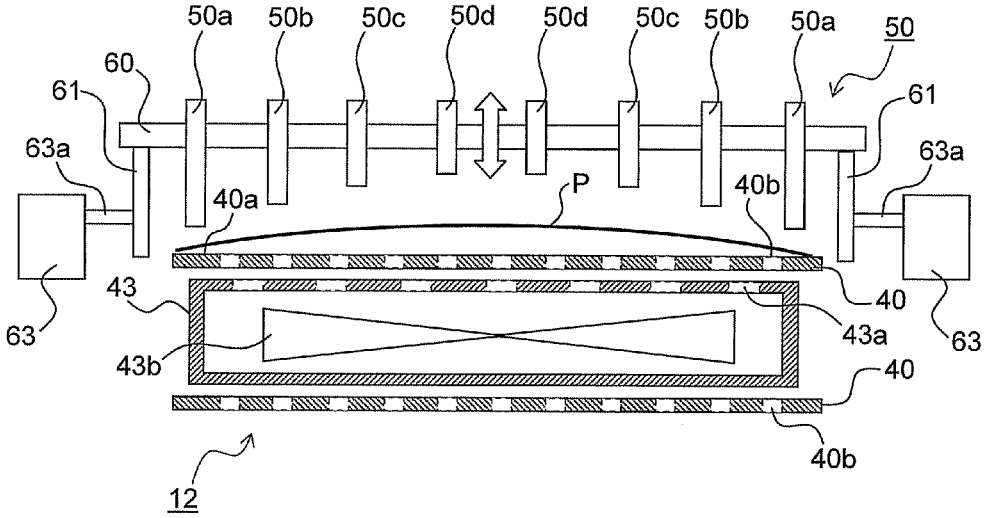
FIG. 9 is a side cross-sectional view of the transport guiding unit of the printer according to a second embodiment of the present disclosure.
Figure 10:
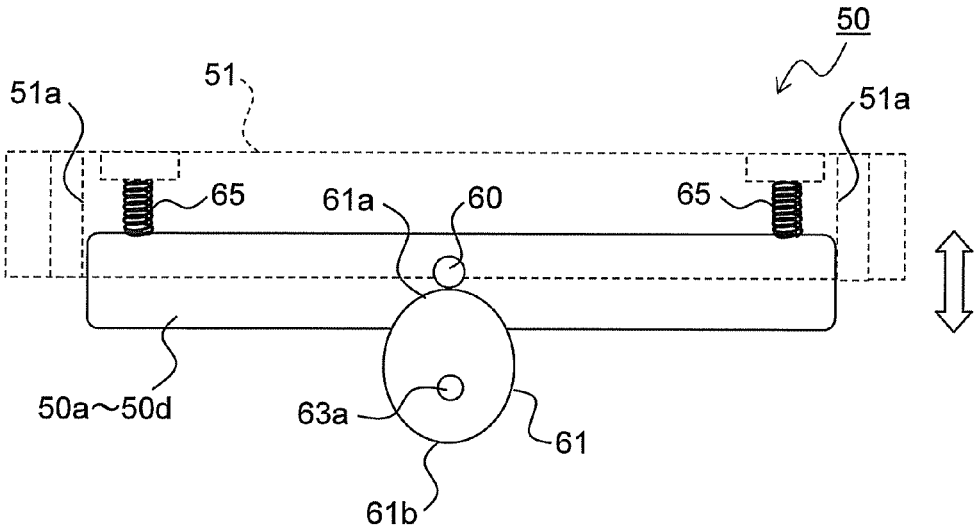
FIG. 10 is a side view of a drive mechanism of ribs viewed from left in FIG. 9 in the transport guiding unit of the printer according to the second embodiment.

FIG. 9 is a side cross-sectional view of the transport guiding unit 50 of the printer 100 according to a second embodiment of the present disclosure. FIG. 10 is a side view of the drive mechanism of the ribs 50*b* to 50*c* in the transport guiding unit 50 of the printer 100 according to the second embodiment, viewed from left in FIG. 9. FIG. 9 illustrates a cross section of the transport guiding unit 50 in the direction perpendicular to the paper sheet transport direction similarly to FIG. 7 and FIG. 8. In this embodiment, protruding heights of the ribs 50*a* to 50*d* can be changed in accordance with a size of the paper sheet P passing the transport guiding unit 50.

As illustrated in FIG. 9 and FIG. 10, there is disposed a shaft 60 penetrating the ribs 50*a* to 50*d* at substantially a center portion in a longitudinal direction (paper sheet transport direction). Both ends of the shaft 60 contact with eccentric cams 61 at the lower side, and the eccentric cams 61 are fixed to output shafts 63*a* of motors 63. In addition, the outermost ribs 50*a* in the paper sheet width direction are biased by coil springs 65 downward at both ends in the longitudinal direction. Further, a transport guiding unit main body 51 for supporting the ribs 50*a* to 50*d* is provided with slide surfaces 51*a* for supporting the ribs 50*a* to 50*d* in a vertically slidable manner.

In the state of FIG. 9 and FIG. 10, a large-radius part 61*a* of the eccentric cam 61 contacts with the shaft 60 so that the coil spring 65 is compressed. The two motors 63 are rotated in a synchronous manner so as to rotate the eccentric cams 61 a predetermined amount from the state of FIG. 9 and FIG. 10. Then, contact positions of the eccentric cams 61 with the shaft 60 move from the large-radius part 61*a* to a small-radius part 61*b*. Thus, the compressed coil springs 65 are expanded so that the shaft 60 moves downward in a horizontal state. As a result, the ribs 50*a* to 50*d* are also moved downward along the slide surfaces 51*a* together with the shaft 60.

On the other hand, when the eccentric cams 61 are rotated in the opposite direction, the contact positions of the eccentric cams 61 with the shaft 60 move to the large-radius part 61*a*. Thus, the coil springs 65 are compressed so that the shaft 60 moves upward in the horizontal state. As a result, the ribs 50*a* to 50*d* are also moved upward along the slide surfaces 51*a* together with the shaft 60. In this way, the protruding height of the ribs 50*a* to 50*d* with respect to the transporting surface 40*a* of the second transporting belt 40 can be changed.

Further, when a width direction size of the paper sheet P passing the transport guiding unit 50 is a maximum size (for example, A4 landscape size), the ribs 50*a* to 50*d* are moved downward to a position such that the outermost ribs 50*a* press the width direction both sides of the paper sheet P. In addition, when the width direction size of the paper sheet P is a minimum size (for example, A5 portrait size), the ribs 50*a* to 50*d* are moved downward to a position such that the innermost ribs 50*d* press the width direction both sides of the paper sheet P.

In this way, regardless of the width direction size of the paper sheet P, the paper sheet P having a downward warp can be securely absorbed and supported on the transporting surface 40*a* of the second transporting belt 40 for transportation. In addition, flutter of the paper sheet P having an upward warp can be suppressed so that jam or skew of the paper sheet P can be effectively suppressed. Note that the drive mechanism of the ribs 50*b* to 50*c* illustrated in FIG. 9 and FIG. 10 is merely an example, and various known drive mechanisms such as a mechanism using a pinion gear and a rack can be used.

Figure 11:
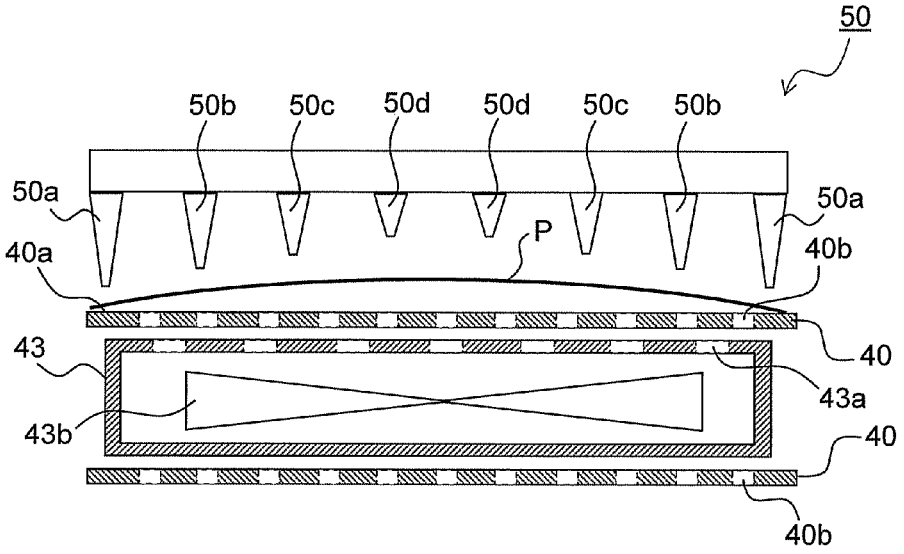
FIG. 11 is a side cross-sectional view of the second belt transporting unit and the transport guiding unit of the printer according to a third embodiment of the present disclosure.

FIG. 11 is a side cross-sectional view of the transport guiding unit 50 of the printer 100 according to a third embodiment of the present disclosure. FIG. 11 illustrates cross sections of the second belt transporting unit 12 and the transport guiding unit 50 in the direction perpendicular to the paper sheet transport direction similarly to FIG. 7 and FIG. 8. In this embodiment, the ribs 50*a* to 50*d* have a tapered shape such that a width thereof becomes smaller from a proximal end (upper end) to a distal end (lower end). A structure of other parts of the transport guiding unit 50 is the same as that of the first embodiment.

With this structure, a contact area between the paper sheet P passing the transport guiding unit 50 and the distal ends of the ribs 50*a* to 50*d* becomes smaller than that in the first embodiment. Therefore, when the paper sheet P warps largely upward, it is possible to effectively suppress generation of jam or skew due to interference between the paper sheet P and the ribs 50*a* to 50*d* and defect of the image recorded on the upper surface of the paper sheet P.

Figure 12:
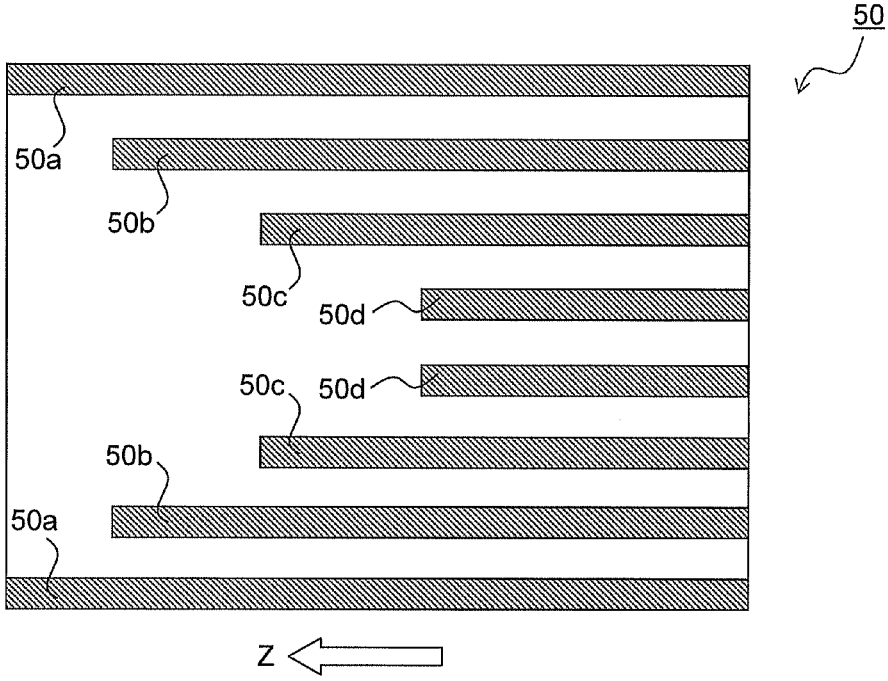
FIG. 12 is a plan view of the transport guiding unit of the printer according to a fourth embodiment of the present disclosure.

FIG. 12 is a plan view of the transport guiding unit 50 of the printer 100 according to a fourth embodiment of the present disclosure. FIG. 12 illustrates the transport guiding unit 50 viewed from the side opposed to the paper sheet P (downward direction), and the paper sheet P is transported in the direction of the arrow Z. In this embodiment, sizes in the transport direction of the ribs 50*a* to 50*d* extending from the upstream end to the downstream side of the transport guiding unit 50 are gradually decreased from the outermost ribs 50*a* in the paper sheet width direction to the innermost ribs 50*d* in the paper sheet width direction. A structure of other parts of the transport guiding unit 50 is the same as that in the first embodiment.

With the structure of this embodiment, as to the paper sheet P of the maximum width direction size (for example, A3 size), the width direction both ends are securely pressed by the outer ribs 50*a* to the downstream side end (left end in FIG. 12) of the transport guiding unit 50. In this case, because the inner ribs 50*b* to 50*d* are gradually shortened, contact between the upper surface of the paper sheet P and the ribs 50*b* to 50*d* can be decreased as much as possible.

Further, when the size in the width direction of the paper sheet P becomes smaller, the ribs pressing the width direction both ends moves from the ribs 50*a* to the inner ribs 50*b* to 50*d* in order. Here, the paper sheet P having a small size in the width direction generally has also a small size in the transport direction, in proportion to the size in the width direction. Therefore, even if the sizes in the transport direction of the ribs 50*b* to 50*d* are short, the width direction both ends of the paper sheet P having a small size in the width direction can be securely pressed. The reason of adopting this structure is that it is sufficient to press the both ends of the paper sheet P during a period until the paper sheet P is completely absorbed by the second transporting belt 40 of the second belt transporting unit 12.

Figure 13:
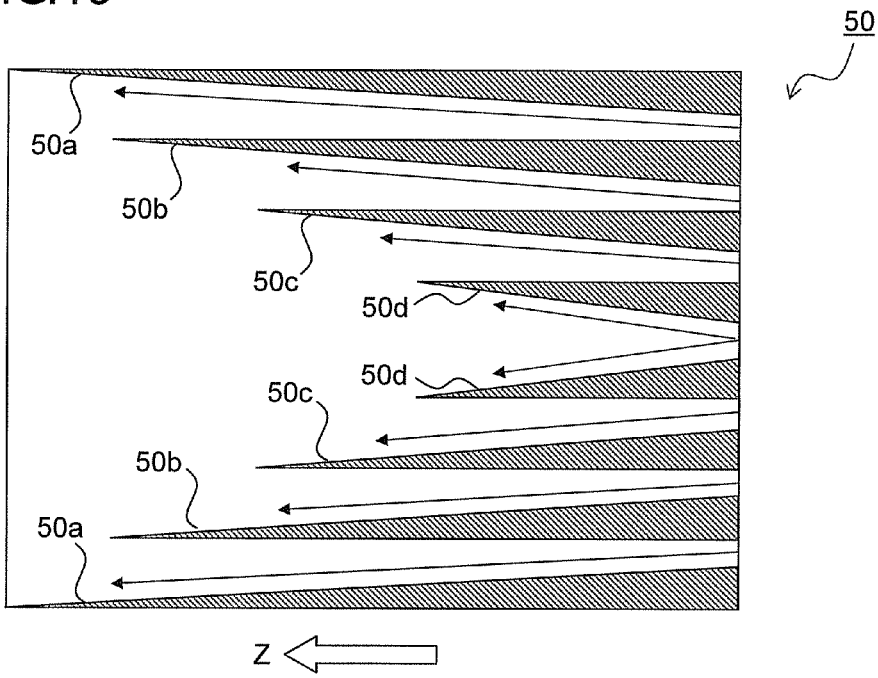
FIG. 13 is a plan view of the transport guiding unit of the printer according to a fifth embodiment of the present disclosure.

FIG. 13 is a plan view of the transport guiding unit 50 of the printer 100 according to a fifth embodiment of the present disclosure. FIG. 13 illustrates the transport guiding unit 50 viewed from the side opposed to the paper sheet P (downward direction) similarly to FIG. 12, and the paper sheet P is transported in the arrow Z direction. In this embodiment, width direction outside surfaces of the ribs 50*a* to 50*d* are formed to be parallel to the transport direction, and width direction inside surfaces are formed with such an inclination as to expand outward in the width direction from an upstream side to the downstream side in the transport direction. A structure of other parts of the transport guiding unit 50 is the same as the fourth embodiment.

With the structure of this embodiment, when a drying blower fan (not shown) is disposed for drying ink on the paper sheet P by blowing air from the upstream side to the downstream side in the transport direction of the transport guiding unit 50, the air from the drying blower fan flows to the downstream side along the width direction inside surface of the ribs 50*a* to 50*d* expanding outward in the width direction. In other words, the ribs 50*a* to 50*d* work as straightening vanes for the air flow from the drying blower fan, and hence the air flows in the entire region in the width direction of the paper sheet P. In addition, the air flow expanding from the inside to the outside presses the upper surface of the paper sheet P to the outside in the width direction, and hence flutter of the paper sheet P can be suppressed.

Figure 14:
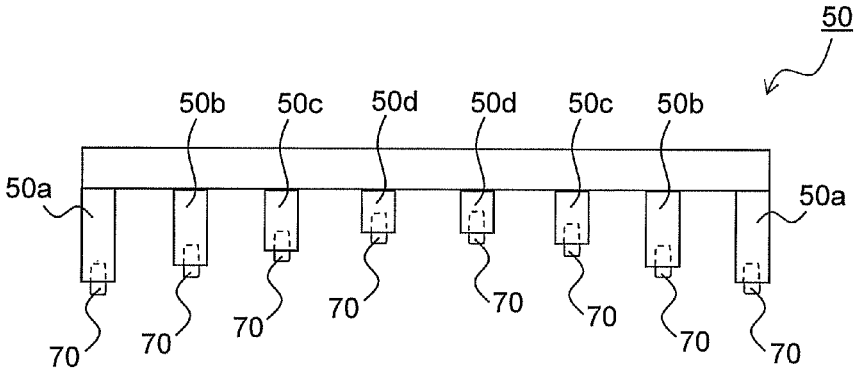
FIG. 14 is a side cross-sectional view of the transport guiding unit of the printer according to a sixth embodiment of the present disclosure.
Figure 15:
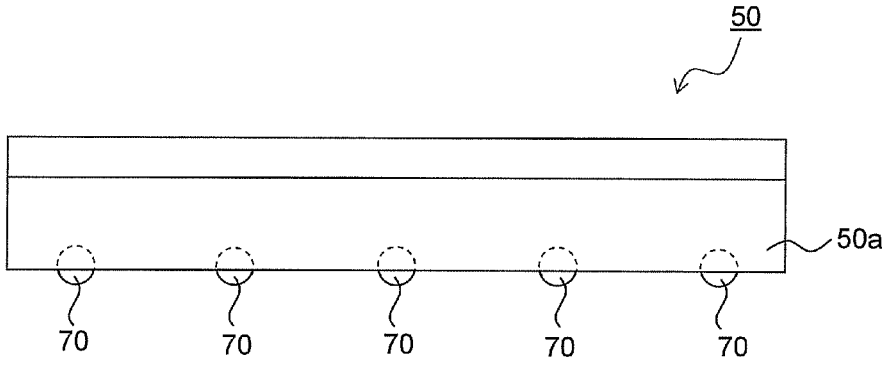
FIG. 15 is a side view of the transport guiding unit of the printer according to the sixth embodiment.

FIG. 14 and FIG. 15 are respectively a side cross-sectional view and a side view of the transport guiding unit 50 of the printer 100 according to a sixth embodiment of the present disclosure. FIG. 14 illustrates a cross section of the transport guiding unit 50 in the direction perpendicular to the paper sheet transport direction similarly to FIGS. 7 to 9 and 11. FIG. 15 illustrates the transport guiding unit 50 viewed from the direction perpendicular to the paper sheet transport direction (left direction in FIG. 14). Note that the second belt transporting unit 12 is not illustrated in FIG. 14. In this embodiment, the distal ends (lower ends) of the ribs 50*a* to 50*d* are provided with rollers 70 (driven rotor) that can rotate in the paper sheet transport direction. A structure of other parts of the transport guiding unit 50 is the same as that in the first embodiment.

The rollers 70 are rotatably supported by rotation shafts (not shown) disposed in the width direction of the ribs 50*a* to 50*d* (direction perpendicular to the paper sheet transport direction), and the rollers 70 can rotate in the paper sheet transport direction. As illustrated in FIG. 15, a plurality of the rollers 70 are disposed in the transport direction of the ribs 50*a* to 50*d*.

With the structure of this embodiment, when the ribs 50*a* to 50*d* press the width direction both ends of the paper sheet P, not main bodies of ribs 50*a* to 50*d* but the rollers 70 contact with the upper surface of the paper sheet P. Therefore, when the upper surface of the paper sheet P contacts with the ribs 50*b* to 50*d*, friction force received by the paper sheet P can be as small as possible. Thus, occurrence of jam or skew of the paper sheet P, and defect of the image recorded on the upper surface of the paper sheet P can be effectively suppressed. In addition, the rollers 70 contacting with the upper surface of the paper sheet P are driven to rotate in the transport direction, the paper sheet P can be transported more smoothly.

Figure 16:
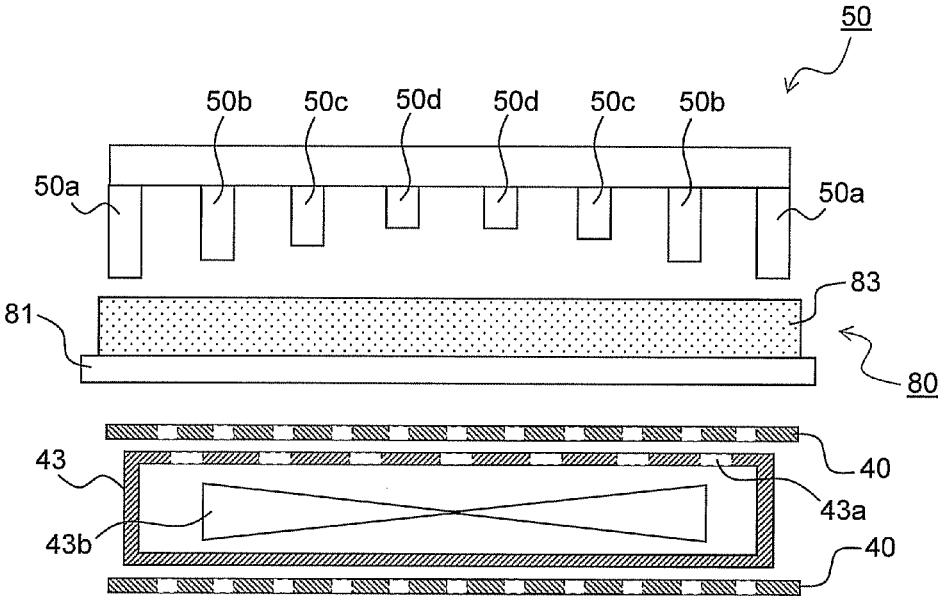
FIG. 16 is a side cross-sectional view of the second belt transporting unit and the transport guiding unit of the printer according to a seventh embodiment of the present disclosure.

FIG. 16 is a side cross-sectional view of the transport guiding unit 50 of the printer 100 according to a seventh embodiment of the present disclosure. FIG. 16 illustrates a cross section of the transport guiding unit 50 in the direction perpendicular to the paper sheet transport direction similarly to FIGS. 7 to 9, and 11. In this embodiment, there is disposed a cleaning mechanism 80 for cleaning the distal ends of the ribs 50*a* to 50*d*. A structure of other parts of the transport guiding unit 50 is the same as that in the first embodiment.

The cleaning mechanism 80 includes a cleaning member 83 fixed to a surface of a frame 81 opposed to the ribs 50*a* to 50*d*. When an image is recorded on the paper sheet P, the cleaning mechanism 80 is moved to a position retreated from the transport guiding unit 50.

When cleaning the distal ends of the ribs 50*a* to 50*d*, the second belt transporting unit 12 is moved downward first. Then, as illustrated in FIG. 16, the cleaning mechanism 80 is moved to between the transport guiding unit 50 and the second belt transporting unit 12. Then, the cleaning mechanism 80 is moved upward, or the transport guiding unit 50 is moved downward, so that the cleaning member 83 is pressed to the ribs 50*a* to 50*d*, and hence the cleaning member 83 absorbs ink adhered to the distal ends of the ribs 50*a* to 50*d*. As the cleaning member 83, a porous material such as sponge or nonwoven fabric is used, which is superior in ink absorption.

With the structure of this embodiment, for example, every time predetermined number of images are recorded, it is possible to use the cleaning mechanism 80 for cleaning the distal ends of the ribs 50*a* to 50*d*, and hence it is possible of prevent ink adhered to the distal ends of the ribs 50*a* to 50*d* from being readhered to the following paper sheet P.

Other than that, the present disclosure is not limited to the embodiments described above, and can be modified variously within the scope without deviating from of the spirit of the present disclosure. For instance, an embodiment obtained by combining the structures of the embodiments described above is naturally included in the scope of the present disclosure.

In addition, the embodiments described above use the vacuum absorption method using the first paper sheet suction unit 30 and the second paper sheet suction unit 43 for absorbing and supporting the paper sheet P, in which the first transporting belt 8 and the second transporting belt 40 are provided with the air suction through holes, and the blower fans 30*b* and 43*b* are disposed inside as means for absorbing and supporting the paper sheet P on the first transporting belt 8 and the second transporting belt 40. Instead of this vacuum absorption method, it is possible to adopt an electrostatic absorption method in which charging devices for charging the first transporting belt 8 and the second transporting belt 40 are disposed, and potential differences are generated between the paper sheet P and the transporting surfaces 8*a* and 40*a* of the first transporting belt 8 and the second transporting belt 40 so that the paper sheet P can be electrostatically absorbed and supported by the first transporting belt 8 and the second transporting belt 40.

In addition, in the embodiments described above, there is exemplified the inkjet recording apparatus that transports the paper sheet P from the sheet feed cassette 2*a* or the manual sheet feed tray 2*b* in a lateral direction. However, the present disclosure can be applied similarly to a vertical transportation type inkjet recording apparatus in which the paper sheet P is transported from the sheet feed cassette 2*a* or the manual sheet feed tray 2*b* in the lower part of the apparatus to the paper sheet discharge tray in the upper part of the apparatus.

In addition, in the embodiments described above, there is described the inkjet recording apparatus using the yellow, magenta, cyan and black color ink for obtaining a full color image. However, the present disclosure can be applied to an inkjet recording apparatus having color ink of another color, or an inkjet recording apparatus having different number of colors.

The present disclosure can be applied to inkjet recording apparatuses for recording by ejecting ink to a recording medium such as a paper sheet in a recording apparatus such as a facsimile, a copier, a printer, or the like. Using the present disclosure, it is possible to provide the inkjet recording apparatus, which can stably transport the recording medium after printing in the recording unit by the second belt transporting unit, and can suppress defect of the recording surface due to contact between the recording surface of the recording medium and the transport guiding unit.

What is claimed is:

1. An inkjet recording apparatus comprising:

a first belt transporting unit including a first transporting belt configured to transport a recording medium by absorbing and supporting the same;

a recording unit disposed to be opposed to the first belt transporting unit so as to eject ink to the recording medium transported by the first transporting belt;

a second belt transporting unit disposed adjacent to the first belt transporting unit on a downstream side thereof in a transport direction of the recording medium, including a second transporting belt configured to transport a recording medium by absorbing and supporting the same on a transporting surface; and a transport guiding unit disposed to be opposed to a part of the transporting surface of the second transporting belt where the recording medium is absorbed and supported, the transport guiding unit including a plurality of ribs extending in the transport direction of the recording medium on a surface facing the transporting surface, wherein protruding heights of the ribs with respect to the transporting surface of the second transporting belt are gradually decreased from an outermost rib to an innermost rib in a width direction of the recording medium.

2. The inkjet recording apparatus according to claim 1, wherein the protruding heights of the ribs with respect to the transporting surface of the second transporting belt can be adjusted in accordance with a width direction size of the recording medium.

3. The inkjet recording apparatus according to claim 2, further comprising a drive mechanism which comprises a shaft penetrating the ribs at substantially a center portion in a longitudinal direction, a pair of eccentric cams contacting with both ends of the shaft at lower side, a biasing member for biasing the ribs in a downward direction, and a slide surface for supporting the ribs in a vertically slidable manner, and which adjusts the protruding heights of the ribs with respect to the transporting surface of the second transporting belt.

4. The inkjet recording apparatus according to claim 1, wherein the ribs have a tapered shape such that a width thereof becomes smaller to a distal end in a protruding direction.

5. The inkjet recording apparatus according to claim 1, wherein sizes of the ribs in the transport direction of the recording medium are gradually decreased from an outermost rib to an innermost rib in the width direction of the recording medium.

6. The inkjet recording apparatus according to claim 5, wherein the ribs have outside surfaces in the width direction of the recording medium formed in parallel to the transport direction and inside surfaces in the width direction formed with such an inclination as to expand to outside in the width direction from an upstream side to a downstream side in the transport direction.

7. The inkjet recording apparatus according to claim 1, wherein a distal end of each rib is provided with a driven roller capable of rotating in the transport direction of the recording medium.

8. The inkjet recording apparatus according to claim 1, further comprising a cleaning mechanism for cleaning distal ends of the ribs.

9. The inkjet recording apparatus according to claim 8, wherein the cleaning mechanism includes a cleaning member made of a porous material capable of absorbing the ink, the cleaning mechanism is movable between a cleaning position and a retreat position in a reciprocating manner, and the cleaning member is opposed to the ribs between the transport guiding unit and the second belt transporting unit in the cleaning position while the cleaning member is retreated from the transport guiding unit in the retreat position.

* * * * *